US007762115B2

(12) United States Patent
Fife, Jr. et al.

(10) Patent No.: US 7,762,115 B2
(45) Date of Patent: Jul. 27, 2010

(54) LOFT AND LIE ADJUSTMENT TOOL FOR GOLF CLUBS

(75) Inventors: John P. Fife, Jr., Phoenix, AZ (US); James Wells, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 427 days.

(21) Appl. No.: 11/867,546

(22) Filed: Oct. 4, 2007

(65) Prior Publication Data

US 2008/0178651 A1 Jul. 31, 2008

Related U.S. Application Data

(60) Provisional application No. 60/886,751, filed on Jan. 26, 2007.

(51) Int. Cl.

| | |
|---|---|
| ***B21D 1/00*** | (2006.01) |
| ***B21D 41/02*** | (2006.01) |
| ***B21D 13/08*** | (2006.01) |
| ***B25B 1/00*** | (2006.01) |
| ***B25B 27/00*** | (2006.01) |
| ***B23P 19/04*** | (2006.01) |

(52) U.S. Cl. ..... 72/293; 72/316; 72/458; 269/6; 29/255; 29/270

(58) Field of Classification Search ..... 72/31.02, 72/293, 316, 409.01, 409.13, 409.19, 457–460, 72/466.6, 705; 33/508, 549; 473/226, 231, 473/244–248; 29/255, 270–278; 269/3, 269/6

See application file for complete search history.

(56) References Cited

U.S. PATENT DOCUMENTS

| | | | | |
|---|---|---|---|---|
| 1,743,825 | A * | 1/1930 | Martens | 72/293 |
| 2,835,040 | A * | 5/1958 | D'Elia | 33/813 |
| 2,973,581 | A * | 3/1961 | Rhodehamel | 33/508 |
| 4,512,222 | A * | 4/1985 | Christophersen | 29/276 |
| 4,858,332 | A | 8/1989 | Thomas | |
| 5,327,766 | A | 7/1994 | Humphreys | |
| 5,421,098 | A | 6/1995 | Muldoon | |
| 5,884,409 | A | 3/1999 | Muldoon | |
| 6,260,250 | B1 | 7/2001 | Hall et al. | |
| 6,363,620 | B1 | 4/2002 | Goodjohn | |
| 6,415,502 | B1 | 7/2002 | Gunshinan et al. | |
| 6,430,829 | B1 | 8/2002 | Williamson et al. | |
| 6,623,372 | B1 | 9/2003 | Beebe et al. | |
| 6,871,414 | B2 | 3/2005 | Burney et al. | |

* cited by examiner

*Primary Examiner*—Teresa M Bonk

(57) ABSTRACT

A golf club adjustment tool for adjusting at least one of loft angle or lie angle of a golf club. The golf club adjustment tool includes a body having a first clamping portion and a second clamping portion. A first end of a first lever is attached to the second clamping portion. A second lever may be removably mated with the body.

13 Claims, 6 Drawing Sheets

LOFT AND LIE ADJUSTMENT TOOL FOR GOLF CLUBS

This is a nonprovisional application claiming the benefit of provisional application No. 60/886,751 filed Jan. 26, 2007.

BACKGROUND OF THE INVENTION

The present invention relates, in general, to golf equipment and, more particularly, to adjusting the loft angle, the lie angle, or both the loft and lie angles of a golf club.

Fitting golf clubs to an individual golfer includes the consideration of several factors such as grip size, shaft length, swing weight, and loft and lie angular relationships of the golf clubs.

The loft angle of a golf club measured at its proper address position is the angle between a vertical plane and a plane that includes the face of the club head. Golf clubs having small loft angles are typically used for low trajectory-long distance golf shots, whereas golf clubs with large loft angles are typically used for high trajectory-short distance golf shots. The particular loft angle for each club in a set of golf clubs is not regulated by any standards or non-variable factors. Instead, the loft angles are normally predetermined by the designer of the clubs to achieve the desired performance characteristics for each club. The loft angles of the clubs are checked and adjusted by bending the clubs as needed to bring them into conformity with the manufacturer's predetermined angular values or to satisfy special requests that a golfer may make.

The lie angle of a golf club measured at its proper address position is the angle between the shaft axis and a line tangent to the center point on the sole of the club head. If the lie angle is too small for a particular golfer, the club head will be angled upwardly as it impacts a golf ball and may "hook" the golf ball to the left. Similarly, if the lie angle is too large for a particular golfer, the club head will be angled downwardly as it impacts a golf ball and may "fade" the golf ball to the right. The correct lie angle for an individual golfer is ideally determined by a trained fitting specialist, such as a Professional Golfer's Association ("PGA") professional, who watches the golfer's swing and can determine the correct lie angle by observing, among other things, the flight of the golf ball.

With properly fitted golf clubs, an individual golfer should be able to achieve optimum performance and shot reliability in accordance with his or her skill level. However, golf clubs can be knocked out of adjustment or the golfer's swing characteristics can change. When this occurs, the golfer's performance level will deteriorate and in many instances, the golfer will not realize that the golf clubs are at fault. Therefore the loft and lie angles of golf clubs should be periodically checked and adjustments made if needed.

When checking or making changes in the loft and lie angles of golf clubs either at the time of manufacture or during subsequent adjustments, the clubs are usually placed one at a time in a special holding fixture that is part of a bench mounted measurement and adjustment mechanism. Such mechanisms usually make accurate measurements and provide visual indications of the loft and lie angles of the club being held in the fixture. With the club still in the holding fixture, special tools are used to bend the club head into the desired angular relationships. However, such bench mounted measurement and adjustment mechanisms cannot be considered portable and only manufacturing or large well-equipped golf shops can justify the cost or dedicate the space required by these mechanisms.

SUMMARY OF THE INVENTION

In accordance with one embodiment, the present invention includes a tool for adjusting at least one of loft angle or lie angle of a golf club. The tool comprises a body having a first clamping portion, a second clamping portion, and a lever, wherein a first end of the lever is attached to the second clamping portion.

In accordance with another embodiment, the present invention provides a golf club adjustment tool, comprising an attachment structure having an adjustable receiving area and a surface. An opening extends from the surface to the adjustable receiving area. A release mechanism having an opening aligned with the opening in the first attachment structure is attached to the attachment structure. A first lever extends through the openings in the attachment structure and the release mechanism, wherein an end of the lever extends into the adjustable receiving area.

DESCRIPTION OF THE INVENTION

Figure 1:
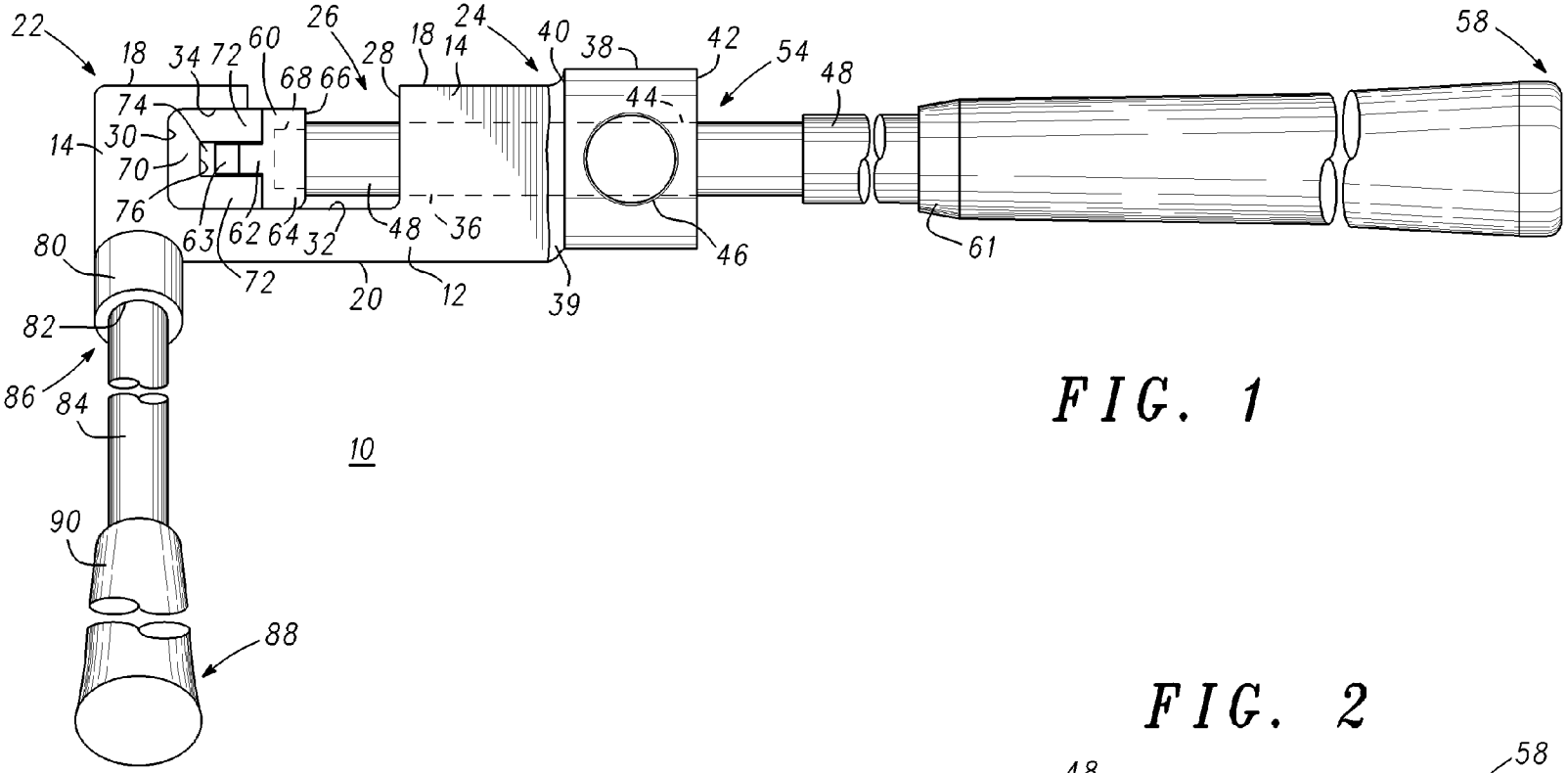
FIG. 1 is a front view of a golf club adjustment tool in a first position in accordance with an embodiment of the present invention.
Figure 7:
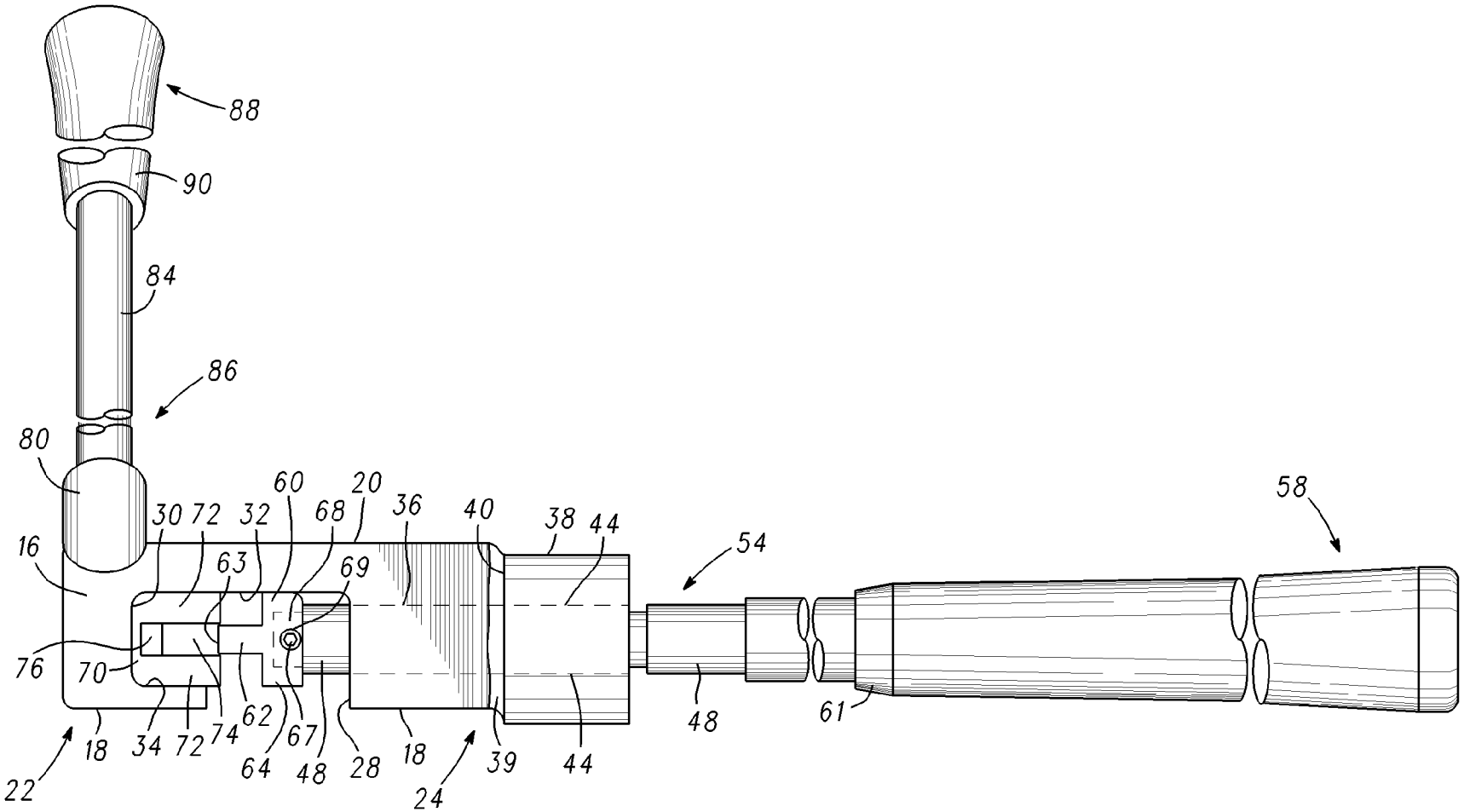
FIG. 7 is a back view of the golf club adjustment tool of FIG. 4.

FIG. 1 is a front view of a golf club adjustment tool 10 in a closed position in accordance with an embodiment of the present invention. Golf club adjustment tool 10 comprises a cuboid shaped body or attachment structure 12 having opposing surfaces 14 and 16, opposing sides 18 and 20, and opposing ends 22 and 24. Surface 16 is shown in FIG. 7. A notch 26 extends from side 18 into body 12 and separates side 18 into two portions. By way of example, notch 26 is L-shaped and has opposing walls 28 and 30, an edge 32, and an edge 34. Edge 34 faces a portion of edge 32. Preferably, notch 26 extends from surface 14 through body 12 to surface 16. An opening 36 (indicated by broken lines) is within body 12 and extends from wall 28 through body 12 to end 24.

A release mechanism or releaser 38 having a cylindrically shaped body and end surfaces 40 and 42 is attached to body 12. Release mechanism 38 has a channel or opening 44 extending from end surface 40 through the cylindrically shaped body of release mechanism 38 to end surface 42. Channel 44 is within releaser 38 and, like opening 36, is indicated by broken lines. Preferably, channel 44 is a threaded channel. End surface 40 is placed in contact with end 24 of body 12, channel 44 is aligned with opening 36, and release mechanism 38 is attached to body 12. Suitable techniques for attaching release mechanism 38 to body 12 include welding, soldering, screwing, or the like. By way of example, release mechanism 38 is welded to body 12 with a weld 39. Alternatively, release mechanism 38 and body 12 can be formed as a unitary structure with a single channel or opening in place of channel 44 and opening 36.

Figure 2:
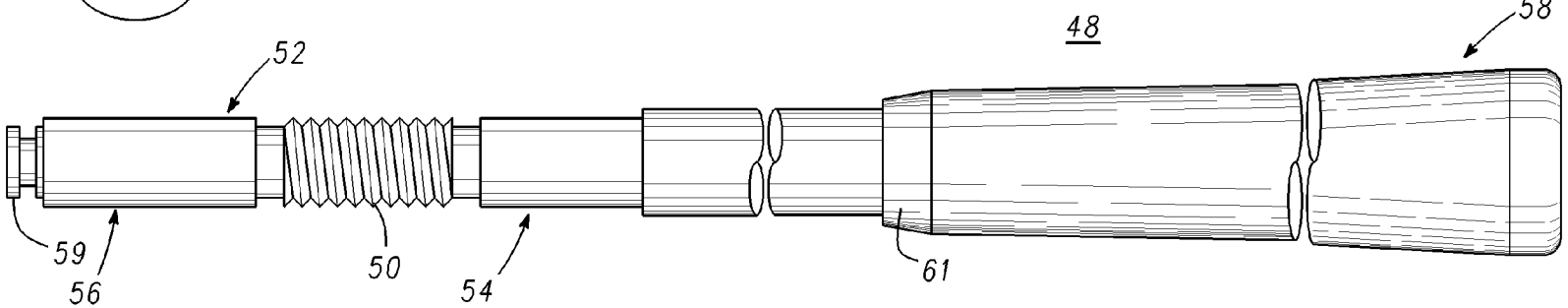
FIG. 2 is a side view of a lever portion of the golf club adjustment tool of FIG. 1.

Release mechanism 38 includes a button 46 for placing threaded regions within channel 44 into one of two states. When button 46 is not depressed, the threaded regions are positioned to cooperate with a threaded portion of a shaft or lever 48 so that the shaft can be screwed into channel 44. When button 46 is depressed, the threaded regions are positioned so that shaft 48 can be pushed into or pulled from channel 44, .i.e., the threaded regions are positioned so that they do not grip shaft 48. Because release mechanism 38 can be used to quickly release the threaded portion of lever 48, it is also referred to as a quick release. Briefly referring to FIG. 2, a side view of shaft or lever 48 is illustrated. Shaft 48 has ends 56 and 58 and a threaded region 50 between two unthreaded portions 52 and 54. A portion of end 56 includes a notched tip 59. Preferably, the diameter of the unthreaded portions 52 and 54 of shaft 48 is larger than the diameter of notched tip 59. Like a golf club, shaft 48 may include a grip 61.

Referring again to FIG. 1, shaft 48 is inserted into channel 44, through opening 36, and out of wall 28. Threaded region 50 cooperates with threads in releaser 38 to allow shaft 48 to be screwed into releaser 38 when button 46 is not depressed.

A T-shaped clamping portion 60 is mounted to notched tip 59 and fixed in place with a set screw 67 (shown in FIG. 7). T-shaped portion 60 is a block that has a stem or a base portion 62 and a crossbar portion 64 having a surface 66. Thus, T-shaped clamping portion 60 is also referred to as a T-shaped block or a clamping element. Crossbar 64 is substantially perpendicular to base portion 62. Base 62 has a beveled surface 63 and is also referred to as an extension. Base 62 and crossbar 64 can be formed as a unitary structure or they can be attached to each other. A hole 68 (indicated by broken lines) extends from surface 66 into crossbar 64. T-shaped clamping portion 60 is fastened to shaft 48 by inserting notched tip 59 into hole 68 and tightening set screw 67. Preferably, set screw 67 is screwed into a screw hole 69 (shown in FIG. 7) in T-shaped clamping portion 60 that is substantially parallel to surface 66 for securing crossbar portion to lever 48. It should be noted that the method for fastening T-shaped clamping portion 60 to notched tip 59 is not a limitation of the present invention.

A U-shaped clamping portion 70 is inserted into the portion of notch 26 bounded by wall 30 and edges 32 and 34. U-shaped clamping portion 70 has legs 72 and a cavity 74 having a beveled wall 76. Base 62 is capable of mating with cavity 74. Beveled wall 76 is also referred to as a beveled surface, U-shaped clamping portion 70 is also referred to as a U-shaped block or a clamping element, and cavity 74 is also referred to as a notch. The bevel angles of beveled surfaces 63 and 76 are preferably selected so that they are substantially parallel to each other when base 62 is positioned in or mated with cavity 74. Clamping portions 60 and 70 cooperate to form a clamp structure and are further described with reference to FIGS. 8 and 9.

A mating barrel or cylindrical extension 80 having a receptacle 82 is attached to body 12. Preferably, cylindrical extension 80 is attached to a corner adjacent to end 22 formed by the intersection of surface 14 and side 18. Cylindrical extension 80 is positioned to be perpendicular to shaft 48.

Figure 3:
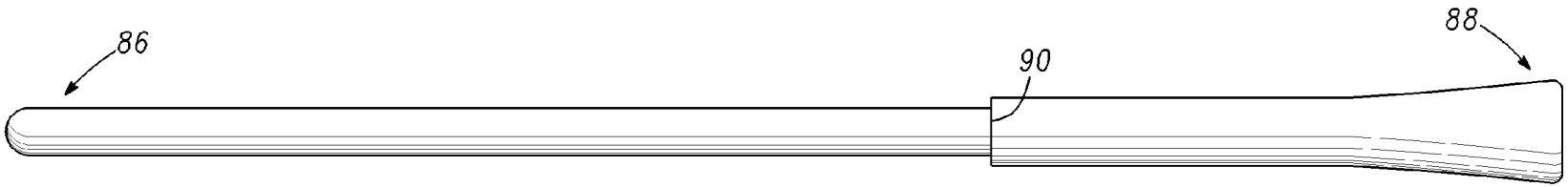
FIG. 3 is a side view of another lever portion of the golf club adjustment tool of FIG. 1.

Golf club adjustment tool 10 further includes a lever 84 comprising a shaft having ends 86 and 88. End 86 may be inserted into receptacle 82 of barrel 80 for adjusting the lie angle of a golf club. Thus, lever 84 may be removably mated with body 12. FIG. 3 is a side view of lever 84 and illustrates ends 86 and 88 and grip 90. Because cylindrical extension 80 is positioned to be perpendicular to shaft 48, lever 84 is also substantially perpendicular to shaft 48 when it is in receptacle 82.

Figure 4:
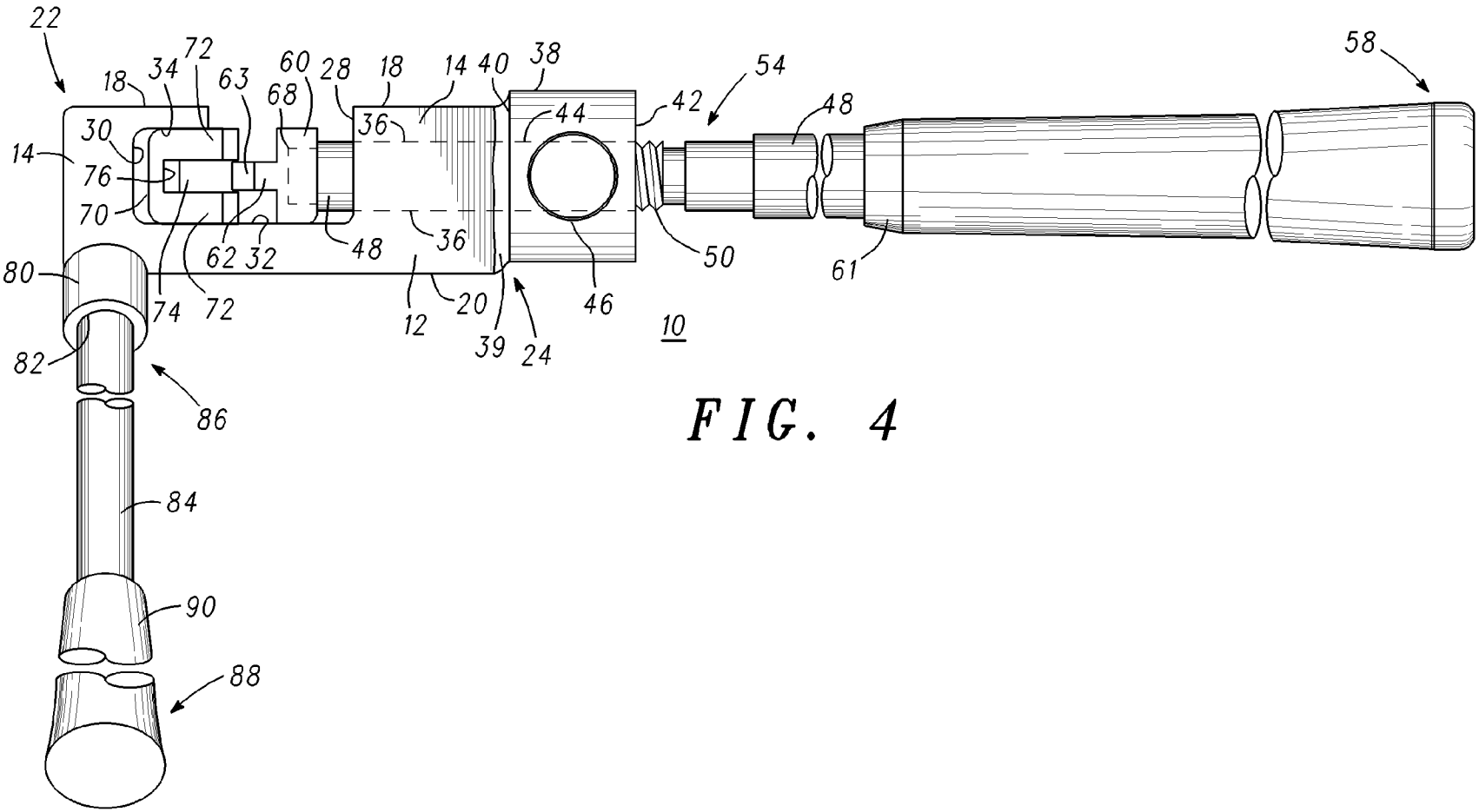
FIG. 4 is a front view of the golf club adjustment tool of FIG. 1 in a second position.

FIG. 4 is a front view of golf club adjustment tool 10 in a partially closed position. More particularly, shaft 48 is shifted so that a portion of threaded region 50 is outside of channel 44, and T-shaped clamping portion 60 is spaced apart from U-shaped clamping portion 70 and from wall 28, i.e., shaft 48 is not inserted as far into cavity 44 and opening 36 compared to its location shown in FIG. 1. Because the location of shaft 48 can be changed, notch 26 is also referred to as an adjustable receiving area.

Figure 5:
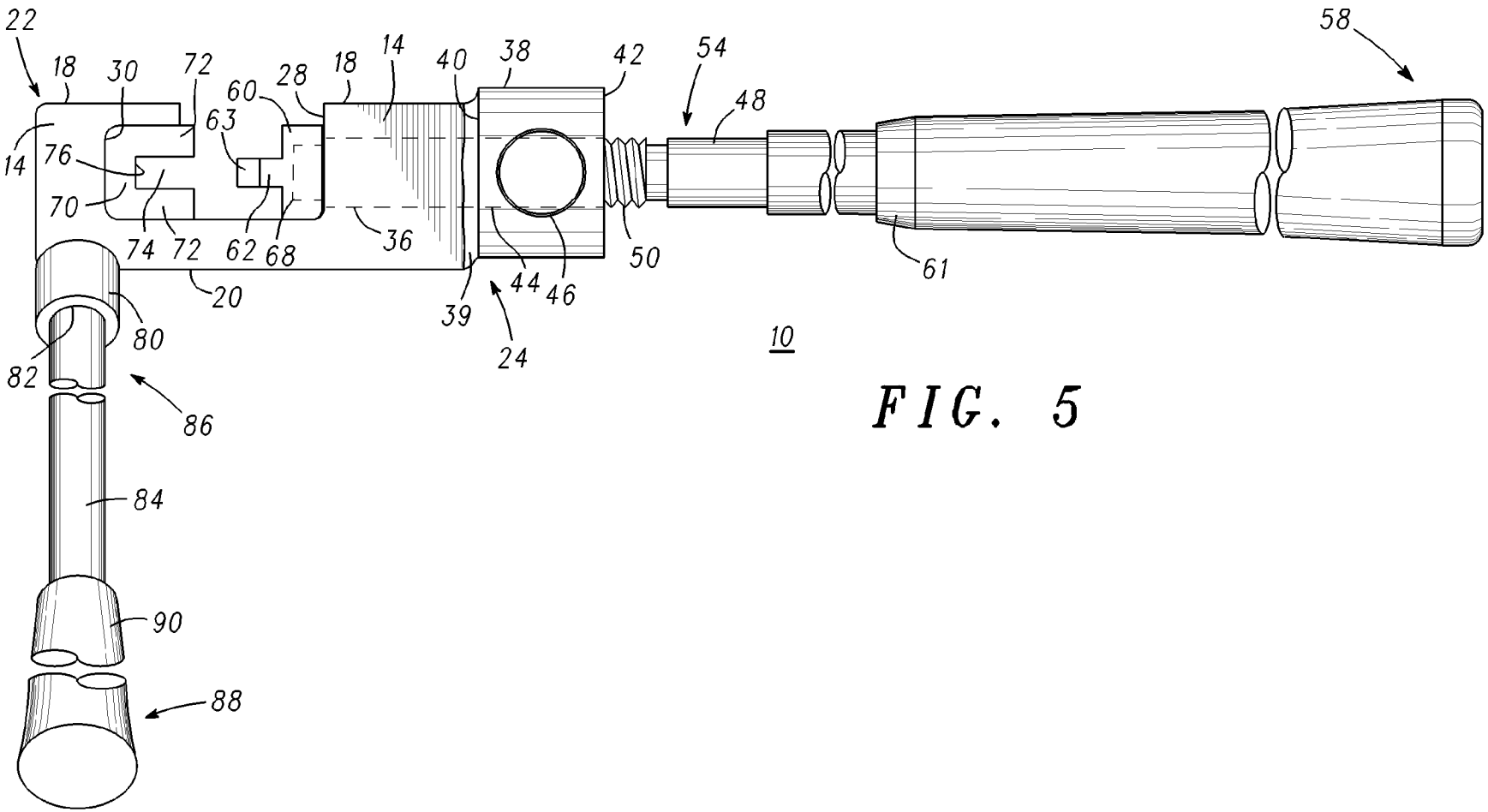
FIG. 5 is a front view of the golf club adjustment tool of FIG. 1 in a third position.

FIG. 5 is a front view of golf club adjustment tool 10 in an opened position. More particularly, shaft 48 is shifted so that a portion of threaded region 50 is outside of channel 44 and T-shaped clamping portion 60 is spaced apart from U-shaped clamping portion 70 and adjacent to wall 28.

Figure 6:
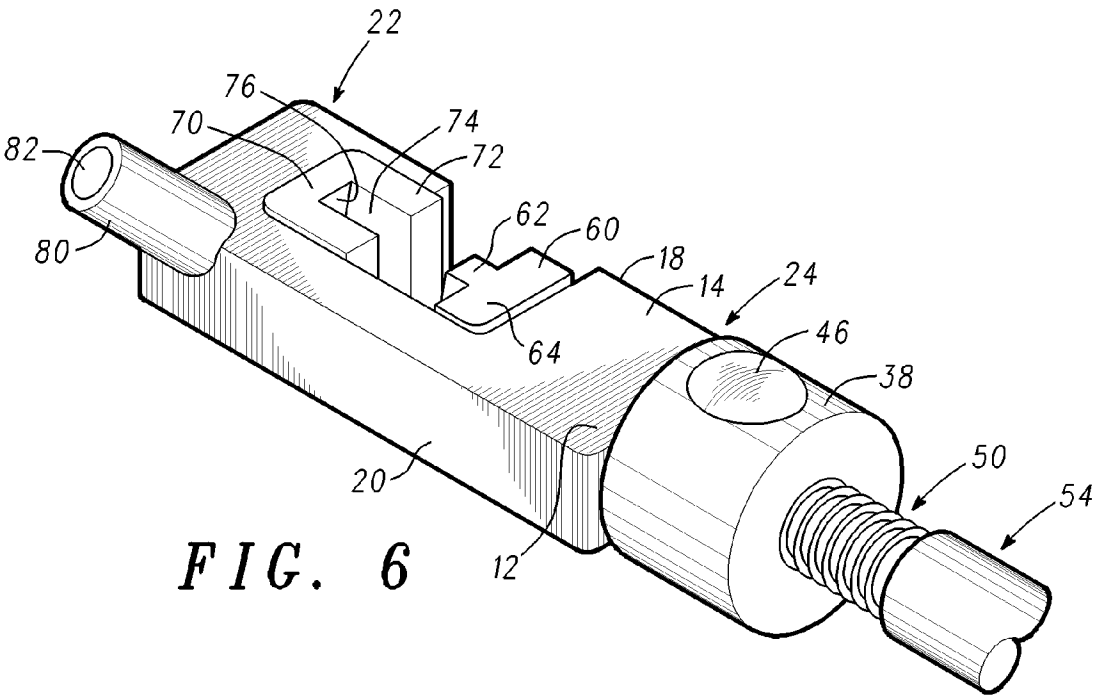
FIG. 6 is a perspective view of a portion of the golf club adjustment tool of FIG. 5.

FIG. 6 is a perspective view of a portion of golf club adjustment tool 10 showing cuboid body 12, surface 14, release mechanism 38, T-shaped clamping portion 60, U-shaped clamping portion 70, threaded portion 50 of shaft 48, unthreaded portion 54 of shaft 48, and cylindrical extension 80.

FIG. 7 is a back view of golf club adjustment tool 10 in a partially closed position. It should be noted that the view of golf club adjustment tool 10 shown in FIG. 5 is rotated 180 degrees with respect to the view of golf club adjustment tool 10 shown in FIG. 3. FIG. 5 further illustrates set screw 67 and set screw hole 69.

Figure 8:
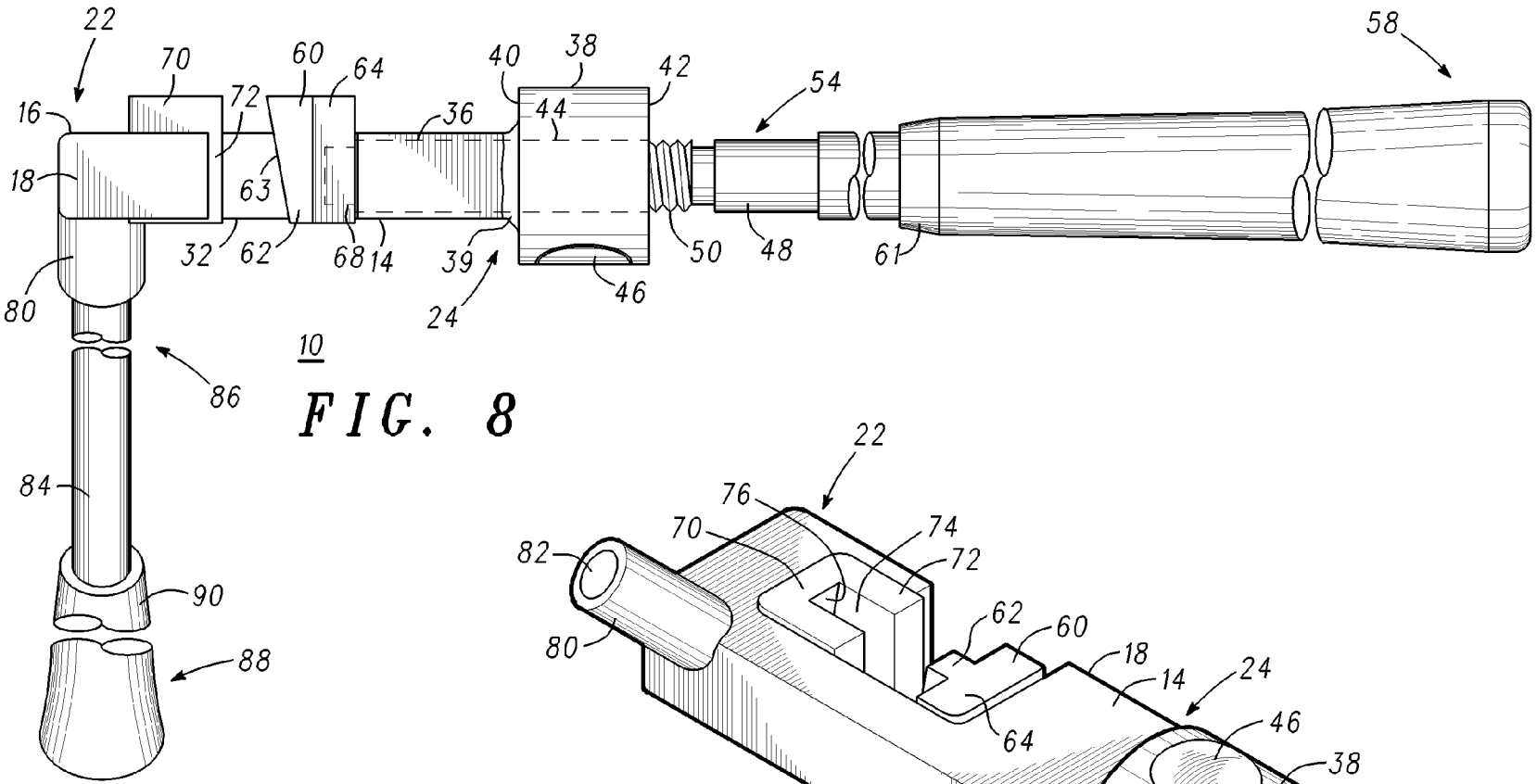
FIG. 8 is a top view of the golf club adjustment tool of FIG. 4.

FIG. 8 is a top view of golf club adjustment tool 10 in the partially closed position. FIG. 8 shows clamping portions 60 and 70 positioned to have surfaces that are flush with surface 14 and opposing surfaces that extend beyond or past surface 16, i.e., that are not flush with surface 16. The positioning of the surfaces of clamping portions 60 and 70 is not a limitation of the present invention. For example, clamping portions 60 and 70 may have opposing surfaces that are flush with corresponding surfaces 14 and 16. Alternatively clamping portions 60 and 70 may have surfaces that are flush with surface 16 and opposing surfaces that extend beyond surface 14 or they may have opposing surfaces that are within the region bounded by surfaces 14 and 16.

Figure 9:
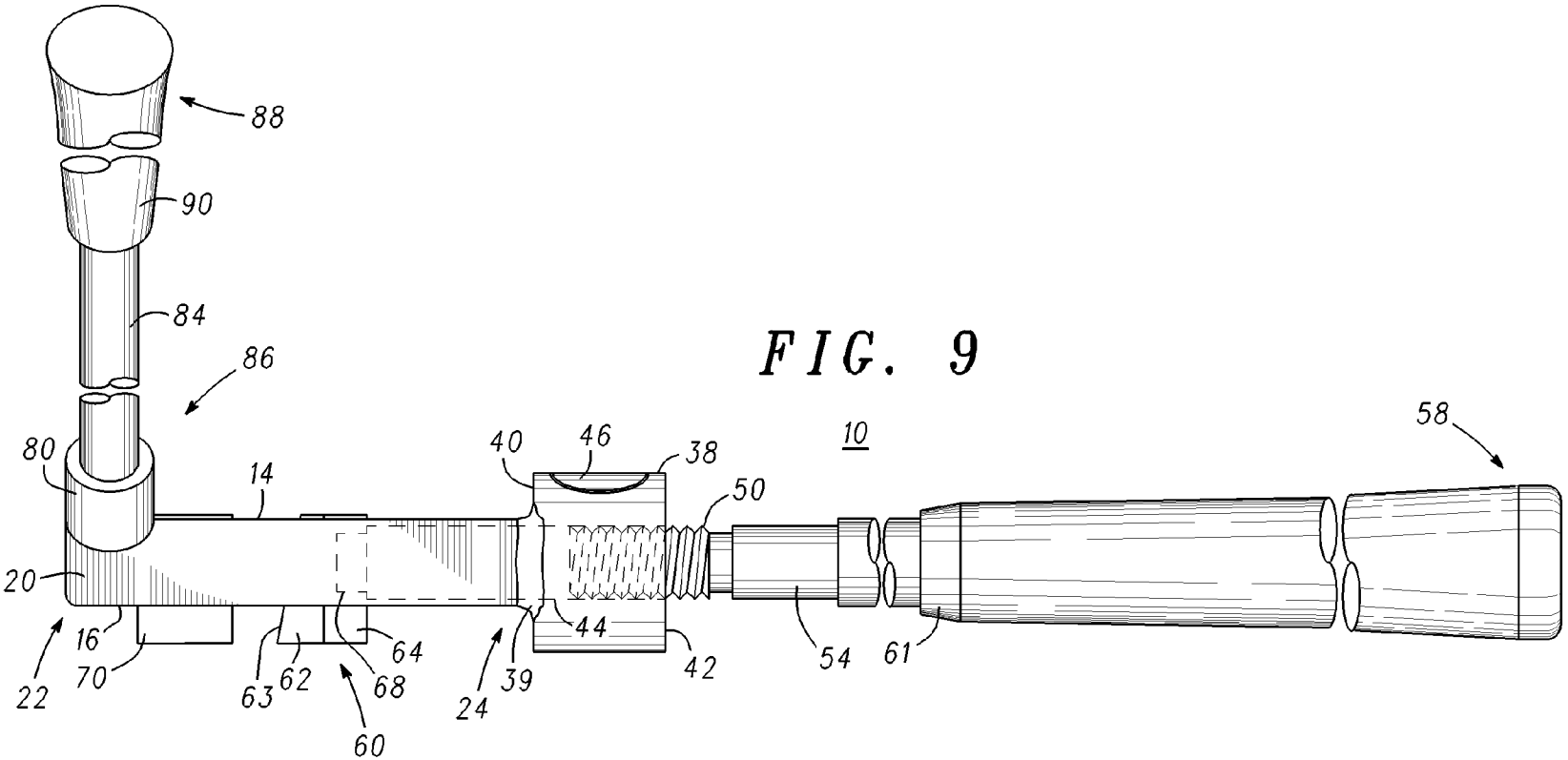
FIG. 9 is a bottom view of the golf club adjustment tool of FIG. 4.

FIG. 9 is a bottom view of golf club adjustment tool 10 in a partially closed position. It should be noted that the view of golf club adjustment tool 10 shown in FIG. 9 is rotated 180 degrees with respect to the view of golf club adjustment tool 10 shown in FIG. 8.

In operation, a golf club is mounted to a loft and lie measurement tool like the tool described in a U.S. provisional patent application having U.S. Pat. No. 7,513,060 titled LOFT AND LIE MEASUREMENT TOOL FOR GOLF CLUBS, invented by James Wells, et al, filed on the same date as this application, and incorporated herein by reference. Golf club adjustment tool 10 is positioned on the hosel (shown in the above-referenced patent application) and clamped in position using clamping portions 60 and 70. The loft angle of the golf club is adjusted by applying pressure to shaft 48 until the desired loft angle is achieved as indicated by a loft angle indicator assembly. The lie angle of the golf club is adjusted by inserting end 86 of lever 84 into cylindrical extension 80 and applying pressure to shaft 48 until the desired lie angle is achieved as indicated by a lie angle indicator assembly. Suitable loft and lie angle indicator assemblies have been described in the above-referenced patent application.

By now it should be appreciated that a golf club adjustment tool capable of adjusting the loft angle, the lie angle, or both the loft and lie angles has been provided. The golf club adjustment tool includes a lever for adjusting the loft angle of a golf club and a lever for adjusting the lie angle of the golf club. It is suitable for use in portable applications and can be configured for use with different golf clubs, i.e., left handed clubs, right handed clubs, center-shafted clubs, and different types of club heads such as, for example, putters and irons.

What is claimed is:

1. A tool for adjusting at least one of loft angle or lie angle of a golf club, comprising:

a body having a first clamping portion and a second clamping portion, the first and second clamping portions defining a clamp opening having a substantially rectangular cross section and a longitudinal axis;

a first lever having first and second ends, the first end slidingly engaging the body and attaching to the second clamping portion, the first lever having a longitudinal axis lying in a plane containing the longitudinal axis of the clamp opening; and a second lever removably mounted to the body of the tool, the second lever having a longitudinal axis lying in a plane perpendicular to the longitudinal axis of the first lever when the second lever is mounted to the body of the tool; further including a release mechanism connected to the body, the release mechanism having an opening and a threaded portion, the threaded portion moveable from an engaged position in which the threaded portion engages a corresponding threaded portion formed on the first lever to a released position in which the threaded portion disengages from the corresponding threaded portion of the first lever to permit the first lever to slide through the opening in the release mechanism.

2. The tool of claim 1, wherein the first lever comprises a shaft having a threaded portion between a first unthreaded portion and a second unthreaded portion.

3. The tool of claim 1, wherein the second clamping portion comprises a T-shaped block removably mounted to the first end of the first lever, the T-shaped block having a crossbar portion and a base portion, the crossbar portion substantially perpendicular to the base portion.

4. The tool of claim 3, wherein the crossbar portion has a first surface and a second surface, wherein a hole extends from the first surface into the crossbar portion.

5. The tool of claim 4, wherein the first end of the first lever extends into the hole extending from the first surface into the crossbar portion.

6. The tool of claim 5, further including a set screw extending into the crossbar portion for securing the crossbar portion to the first lever.

7. The tool of claim 3, wherein the base portion of the T-shaped block extends from a second surface of the crossbar portion and has a beveled surface inclined at an angle relative to a plane normal to the longitudinal axis of the first lever, and wherein the first clamping portion comprises a U-shaped block having a beveled wall having a surface substantially parallel to the beveled surface of the T-shaped block.

8. The tool of claim 3, wherein the crossbar portion and the base portion are a unitary structure.

9. A golf club adjustment tool, comprising:

an attachment structure having an adjustable receiving area and a surface, an opening extending from the surface to the adjustable receiving area;

a quick release mechanism attached to the attachment structure, the quick release mechanism having an opening aligned with the opening in the attachment structure;

a first lever having a first end and a second end and a longitudinal axis, the first lever extending through the openings in the attachment structure and the quick release mechanism, wherein the first end of the lever is in the adjustable receiving area;

a second lever removably attached to the attachment structure, the second lever having a longitudinal axis substantially perpendicular to the longitudinal axis of the first lever when the second lever is attached to the attachment structure;

a first clamping element attached to the attachment structure within the adjustable receiving area, the first clamping element having a clamping portion including a wall having a surface inclined at an angle relative to a plane normal to the longitudinal axis of the first lever; and a second clamping element attached to the first end of the first lever, the second clamping element moveable toward and away from the first clamping element, the second clamping element having a clamping surface opposite and substantially parallel to the inclined wall of the first clamping element to form an elongated opening having a longitudinal axis intersecting the longitudinal axis of the first lever.

10. The golf club adjustment tool of claim 9, wherein the first lever has a threaded region that cooperates with the quick release mechanism for releasing the first lever.

11. The golf club adjustment tool of claim 9, wherein the inclined surface of the first clamping element is bordered by two opposed walls forming a notch and the clamping surface of the second clamping element is formed at the end of a flange, the flange being capable of mating with the notch.

12. The golf club adjustment tool of claim 11, further including a mating barrel attached to the attachment structure, wherein the second lever is removably attached to the attachment structure by inserting the second lever into the mating barrel.

13. The golf club adjustment tool of claim 9 wherein the second clamping element is removably attached to the first lever.

* * * * *